US006299841B1

(12) United States Patent
Rainin et al.

(10) Patent No.: US 6,299,841 B1
(45) Date of Patent: Oct. 9, 2001

(54) BILATERALLY SYMMETRICAL BATTERY POWERED MICROPROCESSOR CONTROLLED LIGHTWEIGHT HAND-HOLDABLE ELECTRONIC PIPETTE

(75) Inventors: Kenneth Rainin, Piedmont; Christopher Kelly, Larkspur; James S. Petrek, Danville, all of CA (US)

(73) Assignee: Rainin Instrument Co., Inc., Emeryville, CA (US)

( * ) Notice: Subject to any disclaimer, the term of this patent is extended or adjusted under 35 U.S.C. 154(b) by 0 days.

(21) Appl. No.: 09/263,131

(22) Filed: Mar. 5, 1999

(51) Int. Cl.[7] ..... B01L 3/02

(52) U.S. Cl. ..... 422/100; 422/99; 73/863.01; 73/864.01; 73/864.11; 73/864.13; 73/864.16; 73/864.18; 436/180

(58) Field of Search ..... 422/99, 100, 922, 422/923, 926, 931, 932; 436/180; 73/863.01, 864.01, 864.11, 864.13, 864.16, 864.18

(56) References Cited

U.S. PATENT DOCUMENTS 3,915,651 * 10/1975 Nishi ..... 23/259
4,369,665 * 1/1983 Citrin ..... 73/864.18
4,567,780 * 2/1986 Oppenlander et al. ..... 73/864.16
4,671,123 * 6/1987 Magnusen, Jr. et al. ..... 73/864.16
4,821,586 * 4/1989 Scordato et al. ..... 73/864.18
4,967,606 * 11/1990 Wells et al. ..... 73/864.18
5,002,737 * 3/1991 Tervamaki ..... 422/100
5,343,769 * 9/1994 Suovaniemi et al. ..... 73/864.18
5,389,341 * 2/1995 Tuunanen et al. ..... 422/100
5,892,161 * 4/1999 Conley et al. ..... 73/864.18
5,983,733 * 11/1999 Strandberg et al. ..... 73/864.11

* cited by examiner

*Primary Examiner*—Jill Warden
*Assistant Examiner*—Kathryn Bex
(74) *Attorney, Agent, or Firm*—Robert R. Meads

(57) ABSTRACT

A bilaterally symmetrical lightweight hand holdable battery powered microprocessor controlled electronic pipette including an axially elongated hollow housing having a vertically extending longitudinal axis. An upper portion of the housing includes a forward compartment containing a forwardly facing alpha-numeric display, a plurality of columns of forwardly facing control keys and plurality of forwardly facing trigger switches arranged in a vertically spaced pattern such that a user in gripping a lower handle portion of the housing in either his or her right or left hand can easily reach with his thumb the control keys, trigger switches as well as a push button of a pipette tip ejector.

7 Claims, 3 Drawing Sheets

BILATERALLY SYMMETRICAL BATTERY POWERED MICROPROCESSOR CONTROLLED LIGHTWEIGHT HAND-HOLDABLE ELECTRONIC PIPETTE

FIELD OF INVENTION

The present invention relates to pipettes and more particularly to a battery powered microprocessor controlled electronic pipette which is light in weight and easily operated by a user over extended periods of time.

BACKGROUND

Since the first commercial introduction of a battery powered microprocessor controlled hand-holdable and easily transportable electronic pipettes by the Rainin Instrument Co., Inc., assignee of the present invention, it has been and continues to be the desire of all electronic pipette manufacturers to provide electronic pipettes which have the functional feel and operational capabilities of manual pipettes such as the world famous PIPETMAN pipette sold exclusively in the United States by the Rainin Instrument Co. for more than 25 years. Specifically in this regard, it continues to be the goal of all electronic pipette manufacturers to develop and produce electronic pipettes that are light in weight, easily holdable and transportable by a user and operational in several modes of operation over extended periods of time without creating physical stress and strain of the hand and forearms of the pipette user. The EDP electronic pipette of the Rainin Instrument Co. introduced in 1984 and its successor models addressed each of the foregoing design criteria. Following Rainin, other companies developing and manufacturing electronic pipettes have also addressed the same criteria and over the years electronic pipettes have become somewhat lighter in weight and more user friendly. However, the desire for an electronic pipette which closely approximates in feel and operational features those of the manual pipette has never been completely achieved. Accordingly, there continues to be a need for such an electronic pipette which is satisfied by the present invention.

SUMMARY OF INVENTION

Basically, the present invention satisfies the foregoing need by providing an electronic pipette which is light in weight, comfortably holdable in either the right or left hand of a user and which is easily operated by the user to direct microprocessor controlled operation of the pipette through different user selected modes of operation for different user selected sample volume and speeds of operation. In providing such a user friendly electronic pipette, the present invention comprises a bilaterally symmetrical design including an axially elongated hollow housing having a vertically extending longitudinal axis and vertically extending and substantially coaxial upper and lower portions. The upper portion of the housing includes a forward compartment containing a forwardly facing alpha-numeric display adjacent a top of the housing. Thus located, the display is readily viewable by a user during all modes of operation of the pipette be the user right handed or left handed. In addition to the display, the forward compartment contains a plurality of columns of forwardly facing control keys as well as a plurality of forwardly facing trigger switches below the columns of control keys. The display, columns of control keys and trigger switches are bilaterally symmetrical relative to the longitudinal axis of the housing. In addition, the upper portion of the housing includes a rear compartment which contains a replaceable battery for powering a microprocessor and motor contained within the housing. The lower portion of the housing comprises a vertically elongated handle which is coaxial with the longitudinal axis of the housing. The handle has contiguous bilaterally symmetrical and vertically extending forward and rear portions for either right or left hand gripping by a user of the pipette. The forward portion of the handle extends forward of the upper portion of the housing and extends vertically downward to a lower end of the housing. Preferably, the forward portion of the handle internally contains and shields an upper portion of a pipette tip ejector. Preferably, the pipette tip ejector has a thumb actuated push button located at a top of the forward portion of the handle and a vertically moveable tip ejector arm extending below the housing and vertically along a pipette tip mounting shaft to encircle the shaft adjacent a lower end thereof. Thus configured, the pipette tip ejector is designed to eject a pipette tip from a lower end of the mounting shaft upon downward movement of the tip ejector arm. Such downward movement is in response to a downward thumb force exerted by the pipette user on the push button while the user is gripping the handle of the pipette. The rear portion of the handle extends rearward from the forward portion and has a hook extending rearward from a back of an upper end of the handle. The hook includes a downwardly curved lower surface for engaging an upper side of an index finger (or middle finger, if desired) of the user while the user is gripping the handle with the thumb of the user free to actuate any of the bilaterally symmetrical control keys, trigger switches and push button in any sequence desired. All this the user is free to do while clearly viewing the alpha numeric display as it responds to the actuation of the control keys and trigger switches. In this regard, the hook, forward and rear portion of the handle and pipette tip ejector including push button and ejector arm are all bilaterally symmetrical relative to the longitudinal axis of the housing. Thus arranged, the pipette of the present invention is easily and comfortably gripped by the user in either his or her left or right hand with the user's index finger under the hook at the rear of the handle. This leaves the user's thumb free to actuate as desired any of the control keys or trigger switches which regulate the various modes of operation of the electronic pipette as well as the volumes of liquid aspirated and dispensed thereby during the several modes of operation of the pipette. All this is accomplished comfortably by the user while exerting minimal thumb forces on the control keys, trigger switches and push button. Thus, the electronic pipette of the present invention is useable by the user over extended periods of time without unduly stressing the user's thumb, hand or forearm enabling accurate and repeatable operation of the pipette in all operational modes of pipette under control of the user.

DETAILED DESCRIPTION OF INVENTION

Figure 1:
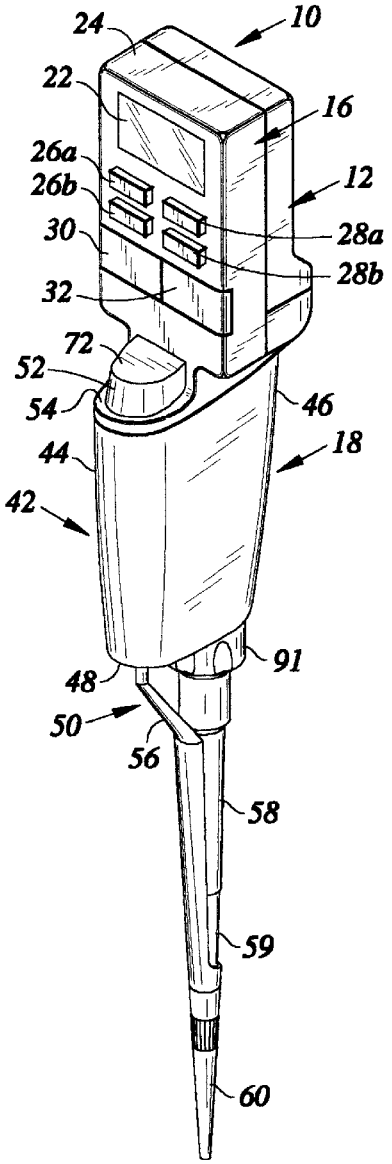
FIG. 1 is a perspective view of a preferred embodiment of the present invention.
Figure 2:
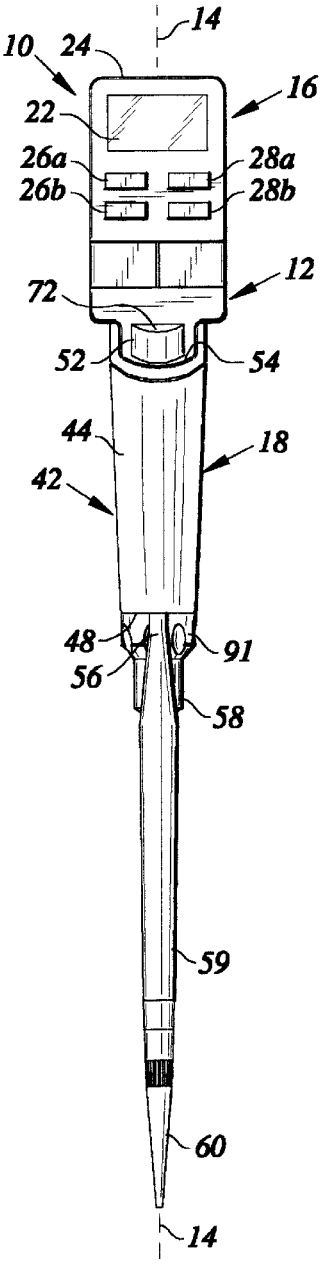
FIG. 2 is a front view of the electronic pipette of FIG. 1.
Figure 3:
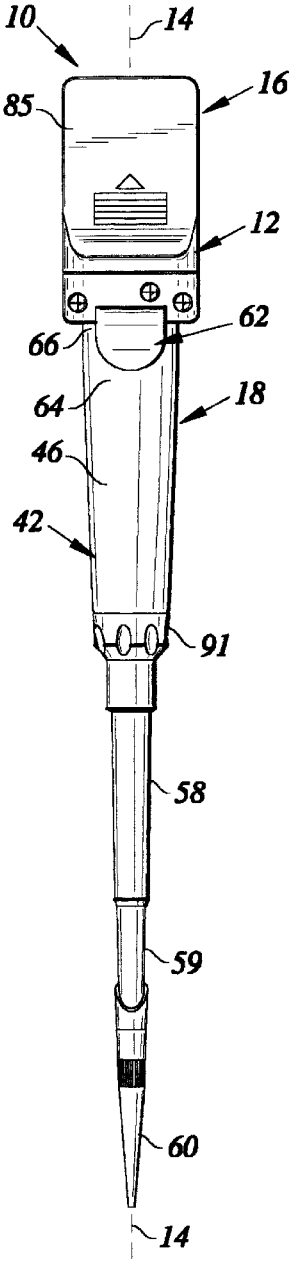
FIG. 3 is a rear view of the electronic of the pipette FIG. 2.
Figure 4:
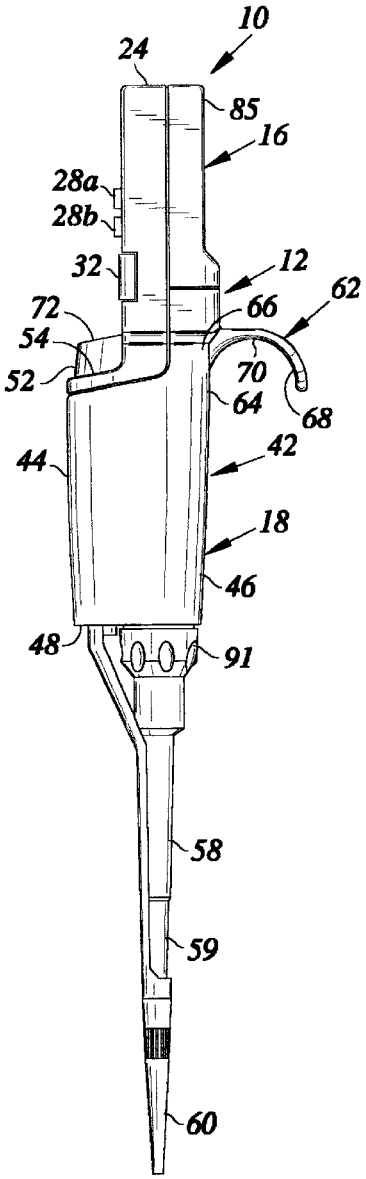
FIG. 4 is a right side view of the pipette of FIG. 2.
Figure 5:
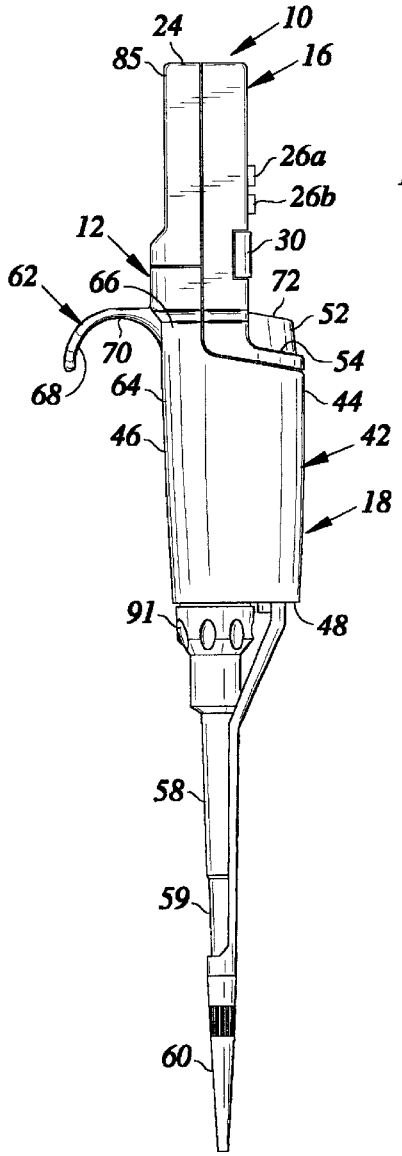
FIG. 5 is a left side view of the pipette of FIG. 2.
Figure 6:
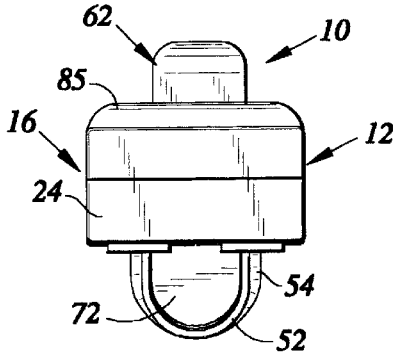
FIG. 6 is a top view of the pipette of FIG. 2.
Figure 7:
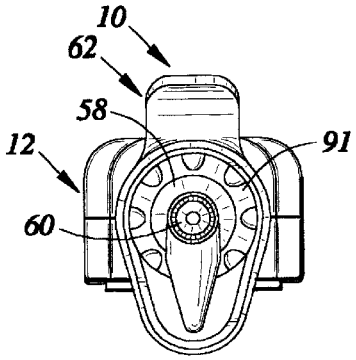
FIG. 7 is a bottom view of the pipette of FIG. 2.

The pipette 10 illustrated in the drawings comprises a bilaterally symmetrical lightweight hand holdable battery powered microprocessor controlled electronic pipette. As illustrated, the pipette 10 includes an axially elongated hollow housing 12 having a vertically extending longitudinal axis 14. The housing 12 includes vertically extending and substantially coaxial upper and lower portions 16 and 18. The upper portion 16 of the housing includes a forward compartment 20. The compartment 20 contains and supports a forwardly facing alpha-numeric display 22 adjacent a top 24 of the housing. The display is a LCD display of conventional design. In addition, the forward compartment 20 contains and supports a plurality of columns (e.g. two) of forwardly facing control keys located below the display and plurality of forwardly facing trigger switches one located immediately below each of the columns control keys. In the illustrated embodiment of the present invention, vertically spaced upper control key 26*a* and lower control key 26*b* comprise a first column of control keys spaced to the left of the longitudinal axis 14 of the housing 12. Similarly, vertically spaced upper control key 28*a* and lower control key 28*b* comprise a second column of control keys to the right of the longitudinal axis 14 a distance substantially equal to the spacing of the control keys 26*a,*26*b* from the axis. Also, a trigger switch 30 is supported in the compartment 20 to the left of the axis 14 below the column of control keys 26*a,*26*b* while a trigger switch 32 is supported in the compartment 20 to the right of the axis 14 below the second column of control keys 28*a,*28*b*. In fact, in the illustrated embodiment, the right side of the trigger switch 30 and the left side of the trigger switch 32 lie substantially on a vertical plane including the longitudinal axis 14.

In this regard, it is an important feature of the present invention that the display 22, the columns of control keys 26*a,*26*b* and 28*a,*28*b* and the trigger switches 30 and 32 are bilaterally symmetrical relative to the longitudinal axis 14 of the housing 12 and as will be described hereinafter in close proximity to a pipette user's thumb while the user is gripping the pipette 10 in his right or left hand and viewing the display 22.

Figure 8:
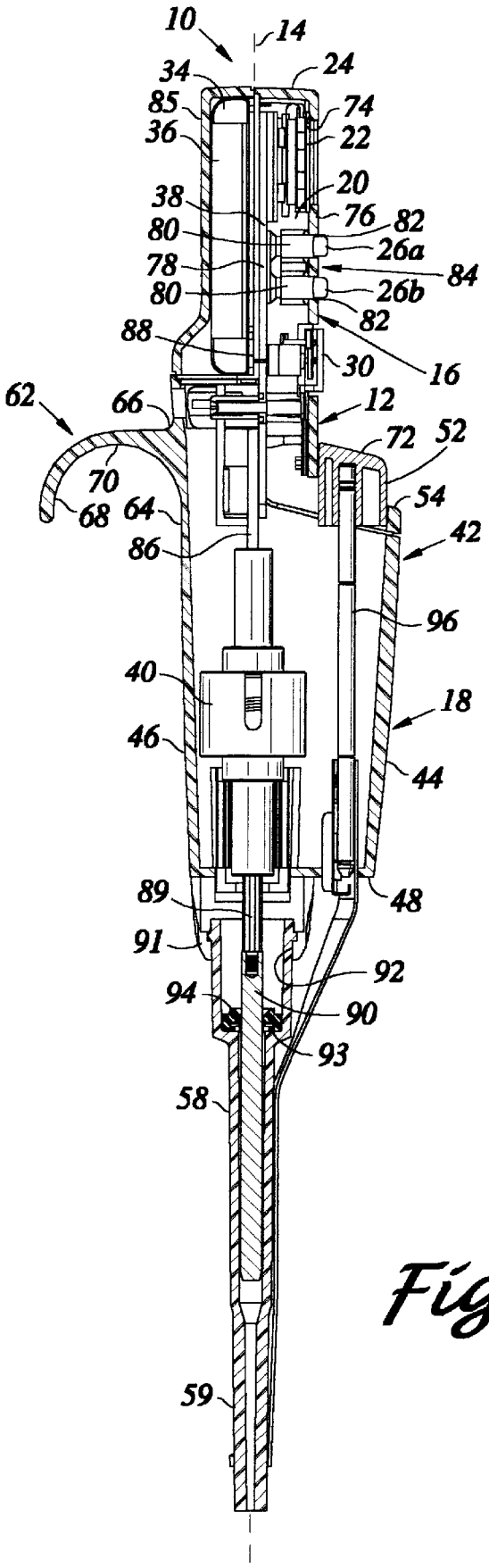
FIG. 8 is a cross sectional side view of the pipette of FIG. 2 showing the internal construction of the pipette and the component parts thereof.

In addition to the foreward compartment 20, the upper portion 16 of the housing 12 includes a rear compartment 34 as shown in FIG. 8. As illustrated, the rear compartment 34 contains and supports a replaceable battery 36 for powering a microprocessor 38 and a motor 40 supported within the housing 12 for operation as described in detail in a concurrently filed patent application Ser. No. 09/263,132 abandoned, entitled "Improved Battery Powered Microprocessor Controlled Hand Portable Electronic Pipette", assigned to the assignee of the present invention and incorporated herein by this reference.

The lower portion 18 of the housing 12, on the other hand, comprises a vertically elongated handle 42 coaxial with the longitudinal axis 14 of the housing. The handle 42 comprises contiguous bilaterally symmetrical and vertically extending forward and rear portions 44 and 46 for hand gripping by a user of the pipette 10.

As illustrated, the forward portion 44 of the handle 42 extends forward of the upper portion 16 of the housing 12. It also extends vertically downward to a lower end 48 of the housing 12 to internally contain and shield an upper portion of a pipette tip ejector 50 having a thumb actuated push button 52 located at a top 54 of the forward portion. In addition, the pipette tip ejector 50 includes a vertically moveable tip ejector arm 56 extending below the housing 12 and vertically along a pipette tip mounting shaft 58 to encircle a shaft adjacent a lower end 59 thereof. The pipette tip ejector 50 may be of conventional design such as included in the well known PIPETMAN pipette or may take the form illustrated and described in U.S. Pat. No. 5,614,153 issued Mar. 25, 1997, assigned to the assignee of the present invention and incorporated herein by this reference. As described fully in the patent and as is well known with respect to the PIPETMAN pipette, it is a function of the pipette tip ejector 50 to eject a pipette tip, such as tip 60, from the mounting shaft 58 in response to a downward thumb force exerted by user on the push button 52.

As illustrated, the rear portion 46 of the handle 42 extends rearward from the forward portion 44 and includes a hook 62 extending rearward from a back 64 of an upper end 66 of the handle. The hook preferably has a downwardly curved lower surface 68 for engaging an upper side of an index finger of the pipette user while the user is gripping the handle in either his or her right or left hand. This leaves the thumb of the user free to actuate any of the bilaterally symmetrical and closely spaced control keys (26*a,*26*b;*28*a,*28*b,*) trigger switches (30,32) and push button (52) in any sequence desired while clearly viewing the alpha-numeric display 22 as it responds to the actuation of the control keys and trigger switches. In this regard, the hook 62, forward and rear portions of the handle 42 and the pipette tip ejector 50 including the push button 52 and ejector arm 54 are all bilaterally symmetrical relative to the longitudinal axis 14 of the housing. Further, it should be noted that an uppermost portion 70 of the lower surface of the hook 62 lies in substantially the same horizontal plane as a top 72 of the push button 52. This further enhances the positioning of the user's hand in gripping the handle 42 such that freedom of movement is afforded the user's thumb to actuate the various closely spaced control keys and trigger switches as well as the push button when it is desired to eject a pipette tip from the mounting shaft of the pipette.

In this regard, the control key 26*a* within the left side column preferably comprises a pipette mode of operation control key while the control key 26*b* in the same column is designed to reset the mode of operation of the pipette all as described in the previously referenced concurrently filed patent application on the electronic pipette.

Further, as illustrated, in the right side column of control keys, the control keys 28*a* and 28*b* control the numeric value displayed by the display 22 as also described in detail the concurrently filed patent application. For example, actuation of the control key 28*a* may increase the volume setting or speed of operation setting for the pipette 10 as indicated on the display 22. On the other hand, actuation of the control key 28*b* may decrease the volume setting or speed of operation setting for the pipette 10 as indicated on the display 22.

Finally, as described in the concurrently filed patent application, in at least one mode of operation of the electronic pipette 10, the first user pressed one of the trigger switches 30,32 may comprise an aspiration actuation trigger switch while the other one of the trigger switches may comprise a dispense actuation trigger switch. In all other modes of pipette operation, either trigger switch 30 or 32 may actuate the next programmed step in the user selected mode of operation of the pipette.

More particularly, in the preferred embodiment of the pipette of the present invention, the internal structure of the pipette provides a pipette having a center of gravity within the handle 42. This provides a balanced pipette which is neither top nor bottom heavy, free of undesired tipping when the user releases his or her grip on the handle and depends upon the hook 42 for support of the pipette. Such balanced structure is represented most clearly in FIG. 8 which illustrates in cross section the internal structure of the electronic pipette.

In this regard, it should be noted that the display 22 is secured by conventional means such as a retaining plate directly behind and within an upper window 74 in a bezel 76 comprising a front face of the upper portion 16 of the pipette housing 12. The display is electrically connected to a printed circuit board 78 mounted vertically within the upper portion of the housing 12 to define the forward compartment 20 for containing the display 22, the control keys (26*a,b;*28*a,b*) and the trigger switches 30 and 32 as illustrated.

The control keys (26*a,b;*28*a,b*) are of conventional design and are each supported by a horizontal tube 80 within an opening 82 in a window 84 in the bezel 76 directly below the upper window 74 containing the display 22. The tubes 80 are moveable axially. Accordingly that the user's thumb in pressing on a forward exposed end of a tube will move a rear end of the tube and a conductive element carried thereby against the printed circuit board 78 to actuate the microprocessor 38 housed on the printed circuit board 78. Such actuation of the microprocessor may change or reset the mode of operation of the pipette or change the alphanumeric displays on the display 22 as well as the volumes of liquid to be handled by and speed of operation of the pipette according to the user selected modes of operation as described in the concurrently filed patent application. In particular, the volumetric settings and speed of aspiration and dispensing indications displayed by the display 22 are controlled by the keys 28*a* and 28*b* and are reflected in modifications of the operation of the pipette in the various 26*b* modes selected by actuation of the control key 26*a,* the control key 26*b* being a "reset" key.

The trigger switches 30,32 on the other hand are in circuit with the microprocessor 38 as described in the concurrently filed patent application and are welded or otherwise connected to the bezel 76. Accordingly a thumb actuation of one of the switches 30,32 will actuate operation of the pipette, such as aspiration, while thumb actuation of the other of the trigger switches 30,32 will actuate a different operation of the pipette and in at least a certain mode of operation will actuate a dispensing of a liquid by the pipette.

Further, as illustrated, the battery 36 is contained in the rear compartment 34 between the printed circuit board 78 and a removable door 85 included in the upper portion 16 of the housing. As described in the concurrently filed patent application, the battery 36 powers the microprocessor 38 and the motor 40 by electrical connections through a power jack connected to the printed circuit board 78. The motor 40 is located in the handle 42 of the pipette 10 below the printed circuit board 78 and is vertically secured by a support rib 86 on a backbone support 88 within the housing. The motor 40 may be of conventional design and preferably is a stepper motor powered by the battery 36 and controlled by the microprocessor 38 in the manner described in the concurrently filed patent application.

As illustrated, an output shaft 89 extends vertically from the motor 40 and is connected in a conventional manner to a piston 90 such that rotation of a rotor within the motor produces axial movement of the output shaft 89 and corresponding axial movement of the piston 90 within the pipette tip mounting shaft 58. The pipette tip mounting shaft 58, in turn, is secured by a threaded nut 91 to a threaded collar 92 extending axially from a lower end of the handle 42. The piston 90 passes through a piston seal 93 which is secured in place around the piston by a spring loaded seal retainer 94 (the spring being removed for clarity of illustration).

Also removed for clarity of illustration is the return spring in the pipette tip ejector 50 shown in FIG. 8. The return spring extends around a rod 96 between the push button 52 and ejector arm 54 secured at opposite ends of the rod. Downward movement of the push button 52 is opposed by the return spring and upon a release of the push button, the return spring returns the push button and the rod 96 to their uppermost position.

In the operation of the pipette 10, axial motion of the output shaft 89 of the motor 40 produces controlled axial movement of the piston 90 in the pipette tip mounting shaft 56 to draw or dispense liquid into or from a pipette tip 60 secured to a lower end of the shaft. In all of the operations of the pipette 10, the user of the pipette grips the handle 42 in his or her right or left hand with his or her index or middle finger under the hook 62. This leaves the user's thumb free to operate the push button 52, the trigger switches 30,32 and/or control keys 26*a,b* or 28*a,b* in any sequence he or she desires while clearly viewing the display 22. The trigger switches and the control keys being bilaterally symmetrical relative to the longitudinal axis 14 of the pipette are easily actuated by the user's thumb without the exertion of forces which would lead to stress or strain of the user's thumb, hand or forearm. This allows the electronic pipette of the present invention to be operated in laboratories by technicians for long periods of time without resulting in fatigue or undesired strain on the thumb or hand of the user.

While a particular preferred embodiment of the present invention has been described in detail herein, it is appreciated the changes and modifications may be made in the illustrated embodiment without departing from the spirit of the invention. For example, the display may be vertically elongated and the column of control keys 26*a* and 26*b* may be positioned on a left side of the display while the column of control keys 28*a* and 28*b* may be positioned on a right side of the display. The bilateral symmetry of the pipette 10 is maintained and the keys and trigger switches are easily reached by the thumb of the user gripping the pipette. Accordingly, the invention is to be limited in scope only by the terms of the following claims.

What is claimed is:

1. A bilaterally symmetrical light weight microprocessor controlled electronic pipette holdable in either the right or left hand of a user with the thumb of user's hand holding the pipette free to actuate forwardly facing control keys to set the operation of the pipette and trigger switches to actuate operation of the pipette while viewing a forwardly facing display, the pipette comprising:

an axially elongated hollow housing having a vertically extending longitudinal axis and including vertically extending and substantially coaxial upper and lower portions;

the upper portion of the housing including a forward compartment and a rearward compartment, the forward compartment containing a forwardly facing alpha-numeric display adjacent a top of the housing, a plurality of columns of forwardly facing pipette operation setting control keys and a plurality of forwardly facing pipette operation actuating trigger switches below the columns of control keys, the display, columns of control keys and trigger switches being bilaterally symmetrical relative to the longitudinal axis of the housing, and the rear compartment containing a replaceable battery for powering a microprocessor and motor contained within the housing;

the lower portion of the housing comprising a vertically elongated handle coaxial with the longitudinal axis of the housing and having contiguous bilaterally symmetrical and vertically extending forward and rear portions for hand gripping by the user of the pipette, the forward portion of the handle extending forward of the upper portion of the housing and extending vertically downward to a lower end of the housing, and the rear portion of the handle extending rearward from the forward portion of the handle and having a hook extending rearward from a back of an upper end of the handle and having a downwardly curved lower surface for engaging an upper side of an index or middle finger of the user while the user is gripping the handle with the thumb of the user free to actuate any of the bilaterally symmetrical control keys and trigger switches in any sequence desired while clearly viewing the alpha-numeric display as it responds to the actuation of the control keys and trigger switches, the hook, forward and rear portions of the handle all being bilaterally symmetrical relative to the longitudinal axis of the housing.

2. The pipette of claim 1 wherein the control keys are below the display.

3. The pipette of claim 1 wherein the forward portion of the handle internally contains and shields an upper portion of a pipette tip ejector having a thumb actuated push button located at a top of the forward portion and a vertically moveable tip ejector arm extending below the housing and vertically along a pipette tip mounting shaft to encircle the shaft adjacent a lower end thereof to eject a pipette tip from the shaft upon downward movement of the tip ejector arm in response to a downward thumb force exerted by the user on the push button, pipette tip ejector including the push button and the ejector arm being bilaterally symmetrical relative to the longitudinal axis of the pipette housing.

4. The pipette of claim 3 wherein an uppermost portion of the lower surface of the hook lies in substantially the same horizontal plane as a top of the push button.

5. The pipette of claim 1 wherein a first one of the columns of control keys comprise a pipette mode of operation control key and a key for resetting the mode of operation of the pipette.

6. The pipette of claim 5 wherein a second one of the columns of control keys comprise keys for controlling the numeric value displayed by the display.

7. The pipette of claim 5 wherein in at least one mode of operation of the pipette a first one of the trigger switches comprises an aspiration actuation trigger switch while a second one of the trigger switches comprises a dispense actuation trigger switch.

* * * * *